US008894099B2

(12) United States Patent
Cordes et al.

(10) Patent No.: US 8,894,099 B2
(45) Date of Patent: Nov. 25, 2014

(54) VACUUM CLEANER SUCTION PIPE

(71) Applicant: fischer Rohrtechnik GmbH, Achern-Fautenbach (DE)

(72) Inventors: Martin Cordes, Sundern (DE); Stephan Cordes, Arnsberg (DE)

(73) Assignee: fischer Rohrtechnik GmbH, Achern-Fautenbach (DE)

( * ) Notice: Subject to any disclaimer, the term of this patent is extended or adjusted under 35 U.S.C. 154(b) by 18 days.

(21) Appl. No.: 13/659,340

(22) Filed: Oct. 24, 2012

(65) Prior Publication Data

US 2013/0285363 A1 Oct. 31, 2013

Related U.S. Application Data

(63) Continuation-in-part of application No. 13/654,904, filed on Oct. 18, 2012.

(30) Foreign Application Priority Data

Oct. 18, 2011 (DE) ..... 10 2011 116 074

(51) Int. Cl.
*A47L 9/24* (2006.01)

(52) U.S. Cl.
CPC ..... *A47L 9/244* (2013.01)
USPC ..... 285/7; 285/298; 285/302

(58) Field of Classification Search
USPC ..... 285/7, 145.1, 298, 302–303; 15/414; 403/105, 109.1, 109.4–109.5, 109.7; 74/422
See application file for complete search history.

(56) References Cited

U.S. PATENT DOCUMENTS

| | | | | |
|---|---|---|---|---|
| 336,414 | A * | 2/1886 | Kerr | 182/10 |
| 3,076,673 | A * | 2/1963 | Kaplan et al. | 294/67.33 |
| 3,094,007 | A * | 6/1963 | Luhrs | 74/422 |
| 3,836,011 | A * | 9/1974 | Sakamoto et al. | 212/349 |
| 3,874,024 | A * | 4/1975 | Ford | 15/339 |
| 5,322,334 | A * | 6/1994 | Hammer | 294/210 |
| 5,324,086 | A | 6/1994 | Hammer | |
| 5,881,601 | A | 3/1999 | Hammer | |
| 7,552,806 | B2 * | 6/2009 | Tong | 191/12 R |
| 8,205,911 | B2 | 6/2012 | Cordes et al. | |
| 2010/0306960 | A1 | 12/2010 | Jonsson et al. | |

FOREIGN PATENT DOCUMENTS

| | | | |
|---|---|---|---|
| DE | 199 58 322 | A1 | 8/2001 |
| EP | 0 650 405 | B1 | 3/2000 |
| EP | 0 805 929 | B1 | 10/2008 |
| WO | 96/24000 | A1 | 8/1996 |

* cited by examiner

*Primary Examiner* — Aaron Dunwoody
*Assistant Examiner* — Fannie Kee
(74) *Attorney, Agent, or Firm* — Roberts Mlotkowski Safran & Cole, P.C.; David S. Safran

(57) ABSTRACT

A vacuum cleaner suction pipe (1) having first, second, and third pipe segments (2, 3, 4), respectively, the pipe segments (2, 3, 4) being telescopically connected to one another, the first pipe segment (2) being located between the second pipe segment (3) and the third pipe segment (4). There is a control device (5), and the pipe segments (2, 3, 4) are mechanically in interaction with one another via the control device (5) so that when the second pipe segment (3) or the third pipe segment (4) is moved manually in an axial direction relative to the first pipe segment (2) the respective other of the second or third pipe segment (3, 4) is moved at the same time by the control device (5).

12 Claims, 8 Drawing Sheets

VACUUM CLEANER SUCTION PIPE

CROSS REFERENCE TO RELATED APPLICATION

This application is a continuation-in-part of application Ser. No. 13/654,904, filed Oct. 18, 2012.

BACKGROUND OF THE INVENTION

1. Field of the Invention

The invention relates to a vacuum cleaner suction pipe, comprising a first pipe segment, a second pipe segment, and a third pipe segment, the pipe segments being telescopically connected to one another and the first pipe segment being located between the second pipe segment and the third pipe segment.

2. Description of Related Art

Vacuum cleaner suction pipes are known in the prior art in a host of configurations. Telescoping vacuum cleaner suction pipes offer the advantage that they can be matched to the body size of the operator or to different usage situations by changing the length for short or long distances in order, on the one hand, to enable ergonomic operation, and on the other hand, to ensure multifunctional use of the vacuum cleaner for various vacuuming tasks.

These vacuum cleaner suction pipes for implementing the telescoping capacity usually comprise a plurality of pipe segments which are arranged in succession and are inserted into one another so that they can be telescoped relative to one another by axially moving the pipe segments. In order to change the length of the vacuum cleaner suction pipe, the pipe segments are displaced manually by the operator, i.e., they are pushed axially into or onto one another. To lock a certain position of the pipe segments, the most varied catch mechanisms are known which reliably prevent unwanted relative motion of the pipe segments during use of the vacuum cleaner suction pipe. Often, depressions in the walls of the pipe segments are used; they interact with corresponding blocking elements on the other pipe segments. For producing the depressions in the walls, the pipe segments must have a certain minimum wall thickness as a result of which the production cost is raised in addition to the material cost.

In vacuum cleaner suction pipes known from the prior art, the position of each pipe segment relative to the following pipe segment can be adjusted independently of one another. This has the advantage that the vacuum cleaner suction pipe is adjustable in a plurality of length configurations. However, the disadvantage arises that, each pipe segment must have its own latching mechanisms with a blocking element which ensures latching of the pipe segments and which must be blocked or opened separately by the operator.

SUMMARY OF THE INVENTION

Proceeding from the aforementioned prior art, a primary object of this invention is to devise a telescoping vacuum cleaner suction pipe which can be easily produced and whose actuation is optimized with respect to the telescoping capacity.

This object is achieved in a vacuum cleaner suction pipe in accordance with the invention in that the pipe segments are mechanically in interaction with one another via a control device so that when the second pipe segment or the third pipe segment is moved manually in the axial direction relative to the first pipe segment the respectively other pipe segment is moved at the same time by the control device.

The three pipe segments of the vacuum cleaner suction pipe are arranged in succession, the first pipe segment being located in the middle between the second pipe segment and the third pipe segment. The length of the vacuum cleaner suction pipe corresponds to the distance between the end of the second pipe segment facing away from the first pipe segment and the end of the third pipe segment facing away from the first pipe segment. The second pipe segment and the third pipe segment can be displaced relative to the first pipe segment by manually pushing by the user, as a result of which the length of the vacuum cleaner suction pipe can be adjusted. The transition regions between the second pipe segment and the first pipe segment or the first pipe segment and the third pipe segment are preferably provided with a seal so that, between the outer end of the second pipe segment and the outer end of the third pipe segment, a continually tight suction channel is formed to guide the intake air. The "outer ends" here mean the ends of the second pipe segment and the third pipe segment facing away from the first pipe segment.

On the pipe segments, there is a control device which mechanically connects the pipe segments to one another so that, when the second pipe segment or the third pipe segment is moved manually relative to the first pipe segment, the respectively other pipe segment—the second pipe segment or the third pipe segment—is moved at the same time by the control device. Preferably, the control device interacts with all three pipe segments by, for example, the second pipe segment and the third pipe segment being moved and the control device being supported on the first pipe segment. However, alternatively, it is also provided that the control device is located only on the second pipe segment and on the third pipe segment.

If a user moves the second pipe segment or the third pipe segment relative to the first pipe segment, consequently therefore, in the axial direction away from the first pipe segment or toward the first pipe segment, the respectively other pipe segment which is not being manually actuated by the user is moved at the same time by the control device which causes a mechanical interaction. The mechanical interaction of the control device is, on the one hand, provided such that the movement of the pipe segment which has been moved at the same time takes place in the same direction as that of the manually moved pipe segment, and on the other hand, however, it is provided that the movement takes place in opposite directions relative to one another so that if, for example, the second pipe segment is moved in the direction of the first pipe segment, the third pipe segment is also moved by the control device in the direction of the first pipe segment, as a result of which the length of the vacuum cleaner suction pipe is reduced.

When the pipe segments are moved relative to one another, the pipe segments are pushed into or onto one another so that the vacuum cleaner suction pipe is altogether lengthened or shortened. Preferably, all pipe segments are the same length, but especially preferably the first pipe segment is twice as long as the second pipe segment and the third pipe segment which are the same length.

Advantageously, the control device is self-locking so that a movement of the pipe segments relative to one another is possible by an axial displacement force which is caused by the user, but in the operation of the vacuum cleaner suction pipe, the self-locking of the control device acts such that an unintentional change in length of the vacuum cleaner suction pipe is prevented. This self-locking makes an actuating mechanism for changing the length of the vacuum cleaner suction pipe unnecessary.

According to a first configuration of the vacuum cleaner suction pipe, it is provided that there is an actuating mechanism for the control device so that, when the actuating mechanism is not actuated, a relative movement of the pipe segments relative to one another is blocked, and that, when the actuating mechanism is manually actuated by the user, a relative movement of the second pipe segment and of the third pipe segment relative to the first pipe segment is released. The actuating mechanism acts on the control device such that, with the actuating mechanism not actuated, movement of the control device is blocked while the movement of the control device is released by manually actuation of the actuating mechanism by a user.

The actuating mechanism, which is thus used at the same time as a blocking mechanism for the relative movement of the pipe segments, therefore, does not act directly on the pipe segments, but simply indirectly via the control device, as a result of which the movement of the pipe segments is released or blocked. This has the advantage that the walls of the pipe segments need no longer be provided with notches, as a result of which the production of the vacuum cleaner suction pipe is simplified.

The actuating mechanism is preferably located in the middle on the first pipe segment in the longitudinal direction, so that a user, for example, can grasp the first pipe segment with one hand at the level of the actuating mechanism in order to hold the vacuum cleaner suction pipe and to operate the actuating mechanism with his hand; at the same time, one of the pipe segments, for example, the third pipe segment, can be moved with the other hand. In doing so, by manually moving the third pipe segment via the control device, at the same time, the second pipe segment is moved in order to easily and comfortably increase or decrease the length of the vacuum cleaner suction pipe.

Another configuration of the vacuum cleaner suction pipe calls for the actuating mechanism to be made as a pressure mechanism. This configuration has the advantage that the actuating mechanism can be actuated by the user with one hand, for example, by the first pipe segment to which the actuating mechanism is preferably attached being encompassed with one hand. Here, the actuating mechanism can be actuated, for example, by pressure with the thumb, as a result of which the movement of the pipe segments to one another is released.

Alternatively, the actuating mechanism can also be made such that the pressure on the actuating mechanism takes place by encompassing the actuating mechanism by a radial force being applied to the actuating mechanism by encompassing it. The radial force, for example, on at least one elastically supported grip area actuates the actuating mechanism and releases a movement of the pipe segments to one another.

Preferably, when the actuating mechanism is actuated, the movement of the pipe segments is relative to one another, while the movement is blocked if the actuating mechanism is not actuated. For this purpose, the actuating mechanism, for example, has an automatic reset, for example, by a spring.

In order to keep the cross section for the suction channel as constant as possible, according to another configuration it is provided that the second pipe segment and the third pipe segment are slipped onto the first pipe segment on opposite ends. To do this, the cross section of the second pipe segment and of the third pipe segment is slightly larger than the cross section of the first pipe segment so that the second pipe segment and the third pipe segment on opposite ends of the first pipe segment can each be slipped onto the latter. The first pipe segment thus forms the inner pipe on which the second pipe segment and the third pipe segment can be displaced as outer pipes. When the length changes, the first pipe segment thus moves within the second pipe segment and the third pipe segment.

Between the first pipe segment and the third pipe segment or the second pipe segment, respectively, there is preferably a seal which seals the suction channel. It is preferably made as an intermediate socket which, at the same time, ensures the guidance of the first pipe segment within the second or third pipe segment. This intermediate socket or the seal is preferably made of a plastic with good sliding properties, for example, PTFE, so that simple displacement of the pipe segments relative to one another is possible.

This configuration with the first pipe segment as the smallest cross section has the advantage that the minimum cross section of the suction channel is the cross section of the first pipe segment since both the cross section of the second pipe segment and also of the third pipe segment is slightly larger.

If the vacuum cleaner suction pipe is telescoped, therefore changed in its length, when shortened both the second pipe segment and also the third pipe segment are moved preferably toward the middle, especially preferably in the direction of the actuating mechanism. To lengthen the vacuum cleaner suction pipe, both the second pipe segment and also the third pipe segment are moved toward the outside away from the first pipe segment.

According to one configuration which has proven especially advantageous, it is provided that the second pipe segment and the third pipe segment are moved opposite one another by the mechanical coupling of the control device. When one of the two outer pipe segments is manually moved by the user, specifically the second pipe segment or the third pipe segment, the control device causes a movement opposite in direction to the movement of the manually moved pipe segment so that the second pipe segment and the third pipe segment are always moved at the same time toward the middle of the first pipe segment or are always moved at the same time toward the outside away from the middle of the first pipe segment.

This configuration has the advantage that the length of the vacuum cleaner suction pipe can be quickly and easily increased or decreased without a plurality of actuating elements having to be actuated. In this configuration, it is sufficient to actuate a single actuating element, as a result of which the movement of both the second pipe segment and also of the third pipe segment is released and is synchronized by the control device. When only one pipe segment is moving, consequently, the correspondingly opposite pipe segment is automatically moved at the same time so the desired length status of the vacuum cleaner suction pipe can be reached very quickly since only one of the movable pipe segments must be moved by half the desired change of length and the other moves automatically at the same time to achieve the desired change in length.

According to another configuration, it is provided that the control device is made as at least one control rod which acts between the second pipe segment and the third pipe segment, on the one hand, such that movement of the second pipe segment and of the third pipe segment takes place in the same direction when actuated manually, and on the other hand, it can also be set up such that, with a suitable transmission ratio, opposite movement of the pipe segments relative to one another is accomplished. Depending on the configuration and arrangement of the control rod, there is support or attachment to the first pipe segment and/or an interaction with the actuating mechanism. Two control rods which are joined together via a joint can also interact in this sense as a single control rod.

According to another configuration which has proven advantageous, it is provided that there are at least two control rods, that a first control rod is connected to the end of the second pipe segment facing away from the first pipe segment and a second control rod is connected to the end of the third pipe segment facing away from the first pipe segment, and that the first control rod and the second control rod interact with one another via the actuating element which is attached to the first pipe segment. The control rods are consequently attached in the end regions of the second pipe segment and third pipe segment facing away from the first pipe segment. Attachment of the control rods to the pipe segments can also take place indirectly, for example, via a socket.

The control rods run normally within the pipe segments. The force is transferred during the movement of the second pipe segment or of the third pipe segment relative to the first pipe segment via the control rods via which the direction of motion of the individual pipe segments is also controlled and optionally synchronized. The manual movement of one control rod always causes a movement of the other control rod in order to move the other pipe segment at the same time.

The actuating element is advantageously located in the longitudinal direction in the middle on the first pipe segment and guides the control rods such that movement of the control rods can be blocked and released by the actuating mechanism. The mechanical coupling of the control rods takes place either via the actuating mechanism or is implemented independently of the actuating mechanism. The force is transferred between the control rods in the case of motion such that the second and third pipe segments move oppositely or in the same direction.

According to one especially preferred configuration, it is provided that the control rods are made as toothed racks, and that the control rods interact with one another via a gear located on the actuating mechanism so that the gear transfers motion of the two racks when one of the two pipe segments is moved manually. The racks preferably are made of a plastic and are provided over the entire length with teeth which can mesh with the teeth of the gear. Alternatively, one control rod can also be provided with teeth only in sections, specifically in the regions in which contact with the gear is possible within the framework of the freedom of movement of the pipe segments.

The racks are each attached to the end of the second pipe segment or of the third pipe segment facing away from the first pipe segment and overlap in the region of the actuating mechanism which is preferably attached to the first pipe segment. "Overlap" here means that they run at least in one segment parallel to one another, the proportion of the overlapping being dependent on the length configuration of the vacuum cleaner suction pipe. Continuous overlapping of the racks takes place in the region of the gear.

The gear is advantageously located on the actuating mechanism and is preferably pivotally mounted between the two racks so that the racks run parallel to one another oppositely on different sides of the gear. The gear engages the teeth of the respective racks so that it is ensured that, when one of the two pipe segments and thus also the respective rack are moved manually by a user, force is transmitted via the gear, as a result of which the respective other pipe segment is moved at the same time preferably in the opposite direction. The racks are guided on the gear such that the teeth are prevented from skipping.

This configuration enables advantageous and simple adaptation of the length of the vacuum cleaner suction pipe. The use of racks and a gear has the advantage that the length of the vacuum cleaner suction pipe can be set almost in a continuous manner since the smallest possible variable distance is the distance between the two teeth of a rack or of the gear.

In order to block the movement of the racks and thus the movement of the pipe segments relative to one another, which is necessary for the use of the vacuum cleaner suction pipe, the gear is blocked by the actuating mechanism so that the racks cannot move relative to one another, and thus, also the pipe segments cannot move relative to one another. By actuating the actuating mechanism, the movement of the gear, especially the rotation, can be released again so that a manual adaptation of the length of the vacuum cleaner suction pipe is possible.

In order to move the pipe segments relative to one another with different speeds, according to another configuration, it is provided that there is a plurality of gears so that a different transmission ratio is implemented between the racks of the second pipe segment and of the third pipe segment. This transmission ratio can be implemented differently, for example, such that the third pipe segment is always moved only by half the distance by which the second pipe segment is moved by a manual movement or vice versa. Other transmission ratios can also be provided which, depending on the application, can be configured and implemented differently—number of gears, arrangement, etc. Via a plurality of gears, in the sense of a gearbox, simplified force transmission between the racks can also be implemented. Furthermore, it is also provided that the transmission ratio between the racks can be switched over on the actuating mechanism, for example, by a slider control.

Within the framework of another configuration of the vacuum cleaner suction pipe, it has proven advantageous if there are four control rods, and that two control rods interact with the second pipe segment and two control rods interact with the third pipe segment. The first control rod of one pipe segment is attached, for this purpose, to the end of the respective pipe segment facing away from the first pipe segment and has a length which corresponds roughly to the length of the pipe segment. On the end of each pipe segment—here the second or third pipe segment—the rack in the transition region between the second pipe segment and first pipe segment or the third pipe segment and first pipe segment engages the rack which belongs to one pipe segment and which for this purpose is turned by 180° with respect to its teeth.

The second control rod of an outer pipe segment—second or third—then runs within the first pipe segment where it is guided in the actuating mechanism. This configuration has the advantage that the length of the engagement of the two racks of one pipe segment in the transition region between the second pipe segment and the first pipe segment or third pipe segment and first pipe segment can be changed so that movement of the second pipe segment and of the third pipe segment in the same or opposite direction is implemented with a uniform transmission ratio, but the overlapping length between the second pipe segment and the first pipe segment or third pipe segment and first pipe segment is different between the second pipe segment and third pipe segment. Overlapping length here means the length with which the first pipe segment runs within the second pipe segment or within the third pipe segment. The overlapping ratio is adjusted preferably via two others, on the second pipe segment and on the third pipe segment, on the end facing the first pipe segment at the time. The maximum overlapping length between the second pipe segment and the first pipe segment is reached in the middle of the first pipe segment, therefore at half the length of the first pipe segment.

To optimize the suction performance, according to another configuration of the vacuum cleaner suction pipem it is provided that the pipe segments have a droplet-shaped cross section that has a suction channel within the cross section of each pipe segment, and that the control device in the pipe segments is outside of the suction channel. This configuration has the advantage that the actual suction channel in which the intake air is routed runs independently of the control device so that no swirling of the intake air occurs, and thus, a power loss is not caused by the control device. The suction channels of the individual pipe segments preferably engage one another exactly like the pipe segments themselves on the length of the vacuum cleaner suction pipe and are sealed and can move relative to one another. The suction channel preferably has a round cross section so that it can be located advantageously in the lower part of the droplet-shaped cross section of the pipe segments. In the upper section of the droplet-shaped cross section of the pipe segments there is then the control device, especially the rack.

While the pipe segments preferably are made of high-grade steel or another metal, the suction change or channels are made of plastic. The suction channels are used solely to guide the air and can be freely moved relative to one another. The locking of the respective position, and thus, of the length of the vacuum cleaner suction pipe takes place as usual via the locking of the pipe segments relative to one another via the control device.

According to a last configuration of the vacuum cleaner suction pipe, it is provided that, on the end of the second pipe segment and of the third pipe segment facing away from the first pipe segment, there is a socket which is permanently connected to the control device and which positions the suction channel within the pipe segments. The respective socket is inserted positively on the end of the second pipe segment or on the end of the third pipe segment into the latter and thus closes it off Only the suction channel which runs within the pipe segments is exposed and can be connected via a corresponding adapter piece on the socket to the suction foot or to the suction hose of a vacuum cleaner. Depending on the configuration, the respective socket is made integral with the suction channel which runs within the pipe segment or separate from it so that the socket and the suction channel positively engage one another. The socket is used for positioning and attachment of the suction channel within the respective pipe segment. The control device, especially the racks, is attached to the socket so that the racks are attached to the end of the second pipe segment or of the third pipe segment facing away from the first pipe segment and force is transferred from the racks via the sockets to the pipe segments and vice versa.

In addition, preferably on the ends of the second pipe segment and of the third pipe segment facing the first pipe segment, there is an intermediate socket which, on the one hand, improves the sliding properties between the pipe segments, and on the other hand, is used for sealing of the pipe segments relative to one another. The intermediate socket also positions the suction channel.

In particular there are a host of possibilities for embodying and developing the vacuum cleaner suction pipe in accordance with the invention. In this regard reference is made to the following detailed description of a preferred exemplary embodiment in conjunction with the drawings.

DETAILED DESCRIPTION OF THE INVENTION

Figure 1:
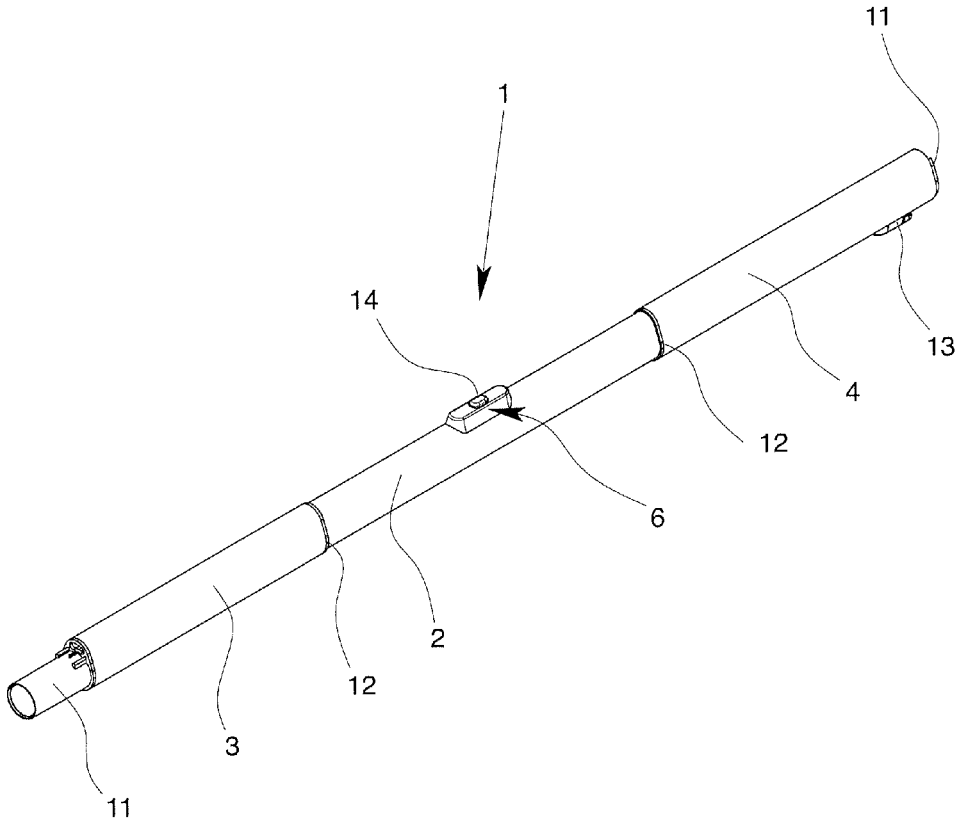
FIG. 1 is a perspective view of an exemplary embodiment of a telescoping vacuum cleaner suction pipe.

FIG. 1 shows an exemplary embodiment of a vacuum cleaner suction pipe 1 with a first pipe segment 2, a second pipe segment 3 and a third pipe segment 4. The three pipe segments 2, 3, 4 are telescopically connected to one another, the first pipe segment 2 being located between the second pipe segment 3 and the third pipe segment 4. In the vacuum cleaner suction pipe 1, there is a control device 5 (shown in FIG. 6) mechanically connecting the three pipe segments 2, 3, 4 to one another so that, when the second pipe segment 3 or the third pipe segment 4 is displaced manually by a user in the axial direction relative to the first pipe segment 2, the pipe segment 3, 4 which is the other at the time is moved at the same time by the control device 5. The movement of the second pipe segment 3 and of the third pipe segment 4 is consequently coupled via the control device 5. The second pipe segment 3 and the third pipe segment 4 are moved in opposite directions relative to one another by the control device 5, i.e., the two pipe segments 3, 4 are moved at the same time toward the middle of the first pipe segment 2 or away from it.

To actuate the control device 5, according to FIG. 1, there is an actuating mechanism 6 which acts on the control device 5 so that, when the actuating mechanism 6 is not actuated, movement of the three pipe segments 2, 3, 4 relative to one another is blocked, and that when the actuating mechanism 6 is manually actuated, relative movement of the second pipe segment 3 and of the third pipe segment 4 relative to the first pipe segment 2 is enabled. The manually set length of the vacuum cleaner suction pipe is thus locked by the control device 5 which acts on the three pipe segments 2, 3, 4.

The second pipe segment 3 and the third pipe segment 4 are slipped onto the first pipe segment 2 on opposite ends of the first pipe segment 2. To do this, the cross sections of the second pipe segment 3 and of the third pipe segment 4 are slightly larger than the cross section of the first pipe segment 2. If the vacuum cleaner suction pipe 1 is being telescoped, the first pipe segment 2 is moved within the second pipe segment 3 and the third pipe segment 4. The first pipe segment 2 accordingly forms an inner pipe while the second pipe segment 3 and the third pipe segment 4 constitute outer pipes.

Figure 6:
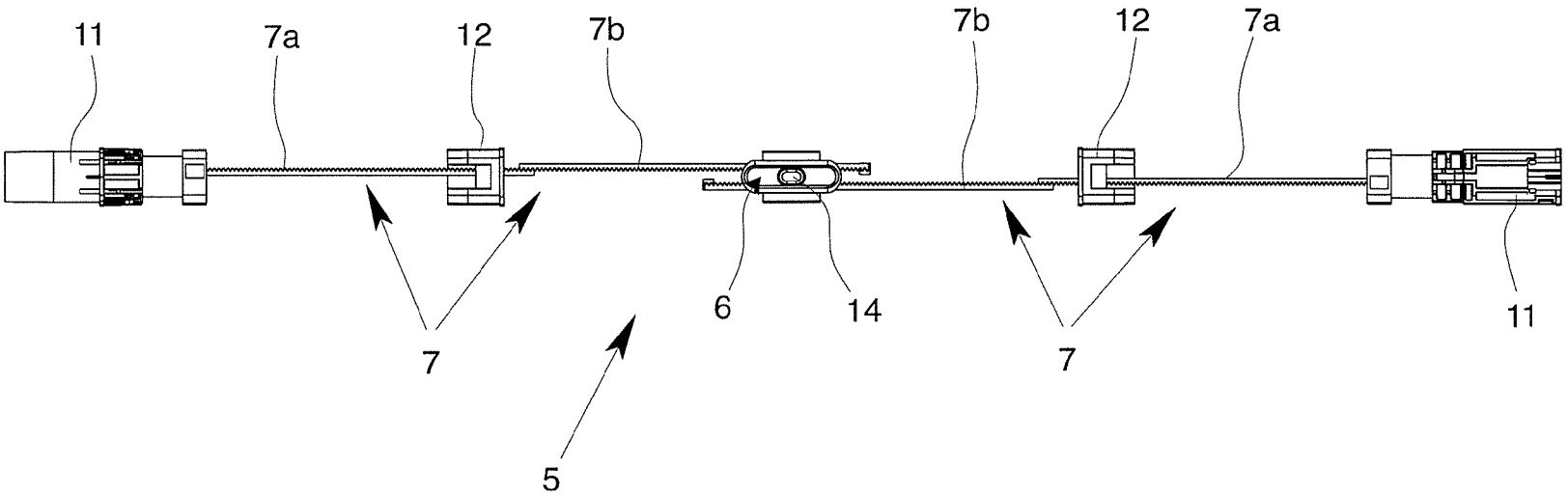
FIG. 6 shows the control device and the sockets of the exemplary embodiment according to FIG. 1, but with four control rods.

The control device 5 (which is shown in FIG. 6) is configured for the exemplary embodiment according to FIG. 1 such that the second pipe segment 3 and the third pipe segment 4 are moved opposite one another by the mechanical coupling of the control device 5 if one of the two pipe segments 3, 4 is moved manually by a user. A manual movement by a user can also take place such that the second pipe segment 3 or the third pipe segment 4 is held and fixed by the user and then the first pipe segment 2 is moved relative thereto.

According to FIG. 6, the control device 5 encompasses a total of four control rods which are made as racks 7. The second pipe segment 3 and the third pipe segment 4 each encompass a first rack 7*a* and a second rack 7*b*, the first rack 7*a* and the second rack 7*b*, in the mounted state, being arranged turned by 180° relative to one another so that, in a transition region, a plurality of teeth of the first rack 7*a* and of the second rack 7*b* engage one another. This transition region is preferably in the region in which the first pipe segment 2 passes into the second pipe segment 3 or into the third pipe segment 4.

The two second control rods 7*b*, specifically that of the second pipe segment 3 and that of the third pipe segment 4, overlap in the region of the actuating mechanism 6. Here, "overlap" means that the second racks 7*b* run parallel to one another in one section, the length of this section depending on the set length of the vacuum cleaner suction pipe. The shorter the total length of the vacuum cleaner suction pipe 1 is set, the longer the section in which the second racks 7*b* overlap. If the vacuum cleaner suction pipe 1 is set to its maximum length, the overlapping of the racks 7*b* is the smallest.

Figure 4:
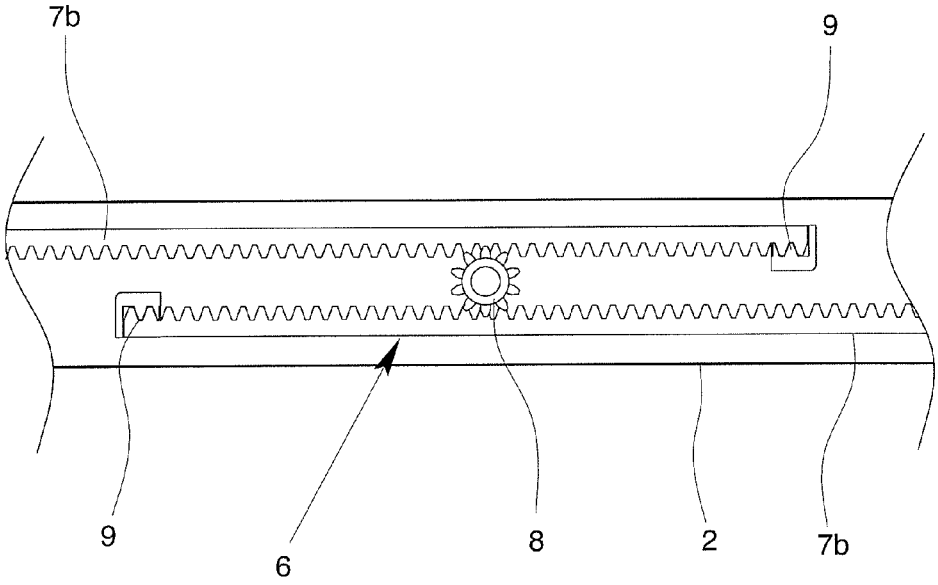
FIG. 4 is a sectional view of the pipe segment with a gear in accordance with an exemplary embodiment of a vacuum cleaner suction pipe.

A detailed view of the vacuum cleaner suction pipe 1 in the region of the actuating mechanism 6 is shown in FIG. 4. According to FIG. 4, the second racks 7*b* overlap in the first pipe segment 2 in the region of the actuating mechanism 6 (not shown in detail). As part of the actuating mechanism 6, a gear 8 is arranged rotationally mounted, the teeth of the gear 8 engaging the teeth of the two second control racks 7*b*. The racks 7*b* run parallel to one another on opposite sides of the gear 8. The racks 7*b* are coupled via the gear 8 such that any movement of one of the two racks 7*b* is transmitted via the gear to the other rack 7*b*. The gear 8 is rotationally mounted and connected to the other components of the actuating mechanism 6 such that the rotation capacity of the gear 8 is released by actuating the actuating mechanism 6. When the actuating mechanism 6 is not actuated, rotation of the gear 8 is blocked by the actuating mechanism 6 so that, altogether, a relative movement of the control device 5, and thus, of the pipe segments 2, 3, 4 relative to one another is blocked. The second racks 7*b* on their overlapping ends have blocking elements 9. The blocking elements 9 prevent the second racks 7*b* from being withdrawn from the gear 8, and thus, also the second pipe segment 3 from being withdrawn from the first pipe segment 2 and the third pipe segment 4 from being withdrawn from the first pipe segment 2.

Figure 4A:
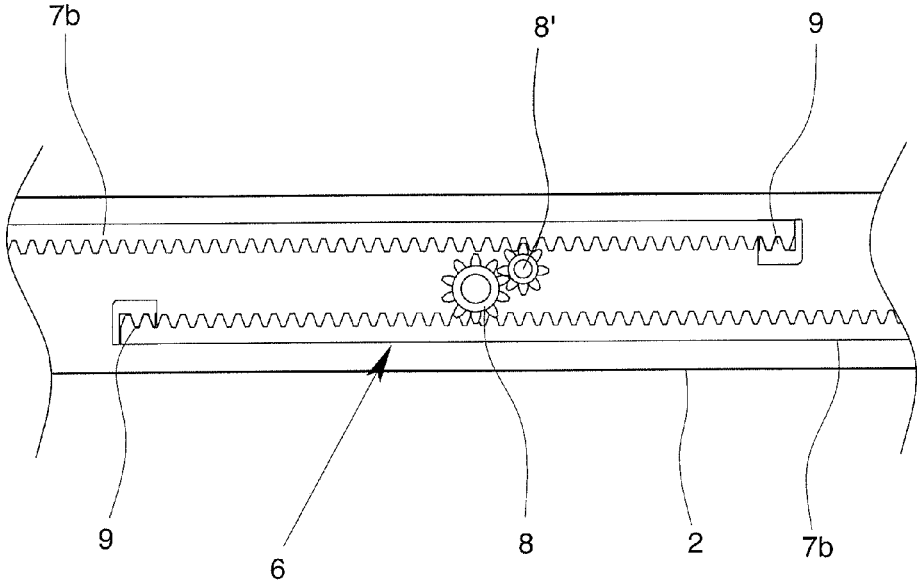
FIG. 4*a* is a sectional view of the pipe segment with two gears to in accordance with an exemplary embodiment of a vacuum cleaner suction pipe.
Figure 4B:
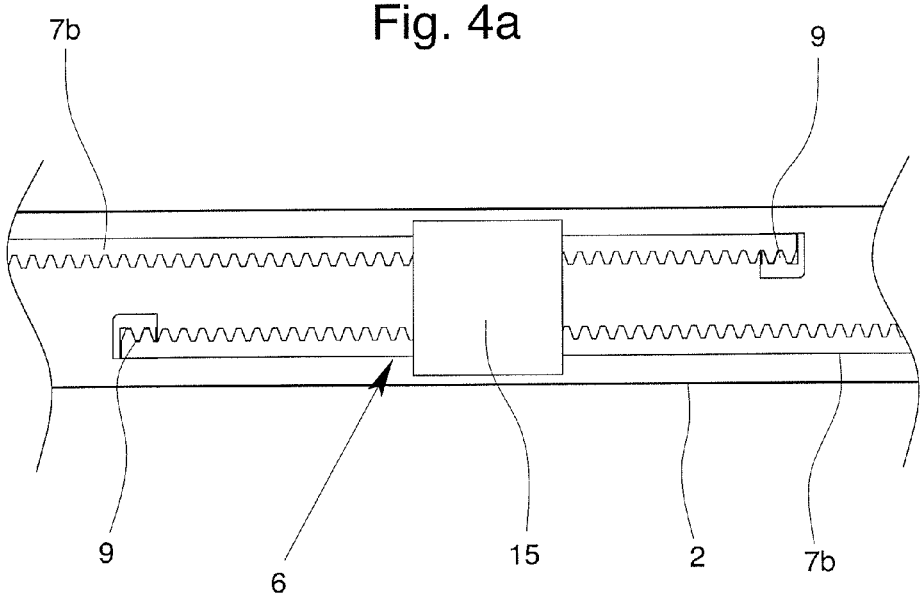
FIG. 4*b* is a view similar to that of FIGS. 4 & 4*a*, but with a gearbox that contains a plurality of gears for producing a gear ratio between the racks.

In order to move the pipe segments relative to one another with different speeds, according to other configurations, e.g., as shown in FIG. 4*a*, it is provided that there is a plurality of gears 8, 8' so that a different transmission ratio is implemented between the racks of the second pipe segment and of the third pipe segment. This transmission ratio can be implemented differently, for example, such that the third pipe segment is always moved only by half the distance by which the second pipe segment is moved by a manual movement or vice versa. Other transmission ratios can also be provided which, depending on the application, can be configured and implemented differently—number of gears, arrangement, etc. Via a plurality of gears, in the sense of a gearbox 15 as shown in FIG. 4*b*, simplified force transmission between the racks can also be implemented. Furthermore, it is also provided that the transmission ratio between the racks can be switched over on the actuating mechanism, for example, by a slider control.

As shown in FIGS. 1 & 6, the actuating mechanism 6 is made as a pressure mechanism so that the movement of the pipe segments 2, 3, 4 relative to one another is released by pressure on the button 14. The button 14 is spring-loaded so that the movement of the pipe segments 2, 3, 4 relative to one another is blocked if pressure is not applied to the button 14.

Figure 7:
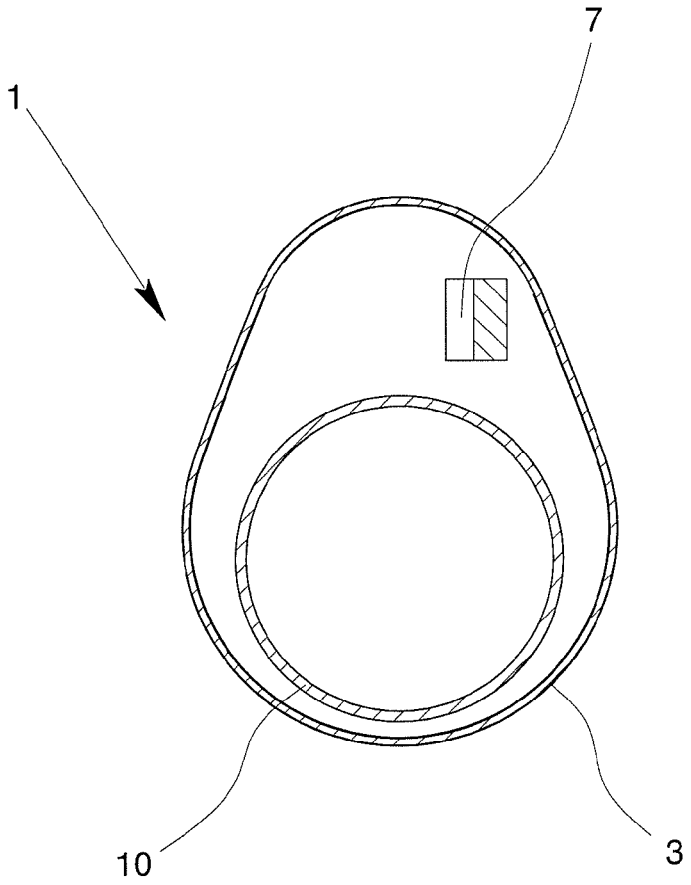
FIG. 7 is a sectional view of an exemplary embodiment of a vacuum cleaner suction pipe.

FIG. 7 shows a cross section of the vacuum cleaner suction pipe 1 in the region of the second pipe segment 3. The pipe segments 3 & 4 are like the second pipe segment 3, here having an essentially droplet-shaped cross section. In the lower region of the droplet-shaped cross section, within the second pipe segment 3, there is a suction channel 10 which is used to guide the intake air within the vacuum cleaner suction pipe 1. The suction channel 10 has a round cross section and offers the advantage that the intake air is routed through the vacuum cleaner suction pipe 1 without being influenced by the components, and thus consequently, without swirls being created within the suction channel by those components 7 & 8.

The individual sections of the suction channel 10 in the pipe segments 2, 3, 4 are also movable relative one another, i.e., they can be telescoped. The sections of the suction channel 10 form a continuous and sealed channel between the two ends of the vacuum cleaner suction pipe 1. The rack 7 likewise runs within the second pipe segment 3, but outside of the suction channel 10. Because the racks 7 of the control device 5 are routed outside of the suction channel 10, power-reducing swirls within the suction channel 10 are prevented. In FIG. 7, the components of the vacuum cleaner suction pipe 1 which are present in the posterior planes are not shown.

In addition to the control device 5, FIG. 6 shows connectors 11 which, in the mounted state of the vacuum cleaner suction pipe 1, are inserted into the ends of the second pipe segment 3 and of the third pipe segment 4 facing away from the first pipe segment 2. The connectors 11 encompass the suction channel 10 positively and keep it at its position within the respective pipe segment 3, 4. The socket 11 for the vacuum cleaner suction pipe 1 constitutes the interface of the suction channel 10 to the suction part of the vacuum cleaner suction pipe 1 (not shown) and on the other side to the suction hose (not shown). The first racks 7*a* of the control device 5 are attached to the connectors 11. Force is transferred via this connection from the second pipe segment 3 and the third pipe segment 4 to the racks 7 and vice versa, i.e., from the racks 7 to the second pipe segment 3 and the third pipe segment 4.

Furthermore, in the mounted state, on the end of the second pipe segment 3 and of the third pipe segment 4 facing the first pipe segment 2, intermediate sleeves 12 are inserted into the second pipe segment 3 and the third pipe segment 4. The intermediate sleeves 12 are used, on the one hand, to hold the suction channel 10 within the pipe segments 3, 4, and on the other hand, they are used to simplify the sliding process between the first pipe segment 2 and the second pipe segment 3 or the third pipe segment 4. The intermediate sleeves 12 are used as sliding elements between the pipe segments 2, 3, 4, and at the same time, seal the transition sites.

Figure 2:
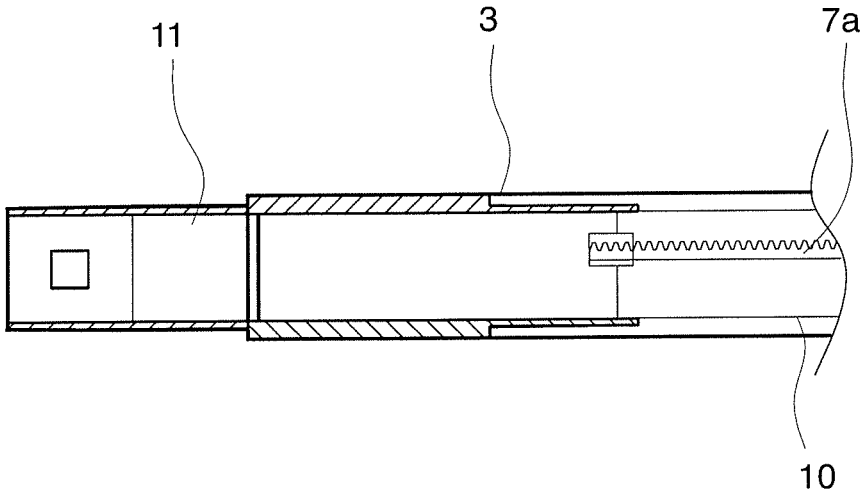
FIG. 2 is a sectional view of an end portion of an exemplary embodiment of a vacuum cleaner suction pipe.

FIG. 2 shows one exemplary embodiment of an end region of the second pipe segment 3 facing away from the first pipe segment 2 in which the suction channel 10 runs and is positively connected to the connector 11. The first rack 7*a* is likewise attached to the connector 11 so that force is transferred from the rack 7*a* via the socket 11 to the second pipe segment 3. The connector 11 is also used as an interface for the suction channel 10 to route the intake air, especially for connection of the vacuum cleaner suction pipe 1 to a suction base (not shown).

Figure 3:
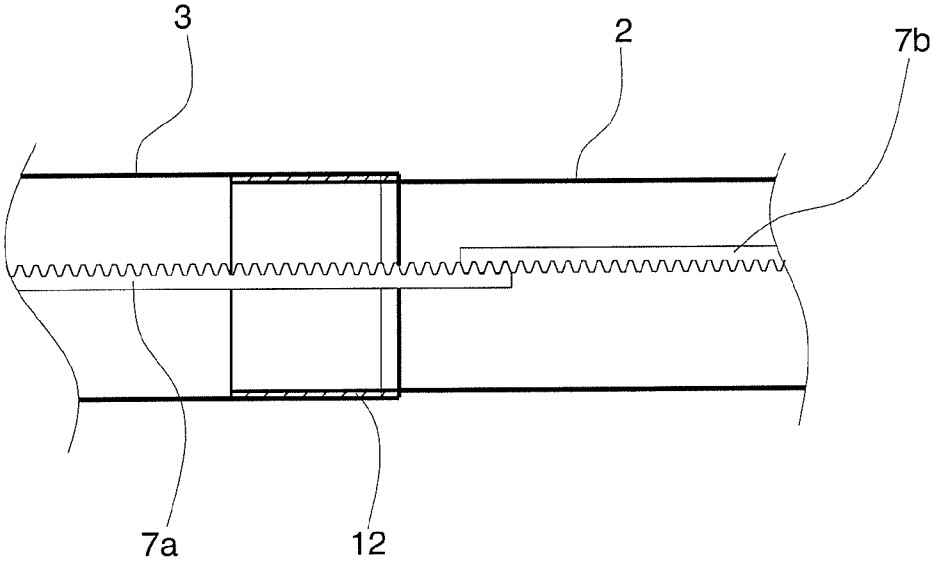
FIG. 3 is a sectional view of a transition section between two pipe segments of an exemplary embodiment of a vacuum cleaner suction pipe.

FIG. 3 shows the transition region between the second pipe segment 3 and the first pipe segment 2 of an exemplary embodiment of the vacuum cleaner suction pipe 1. Between the first pipe segment 2 and the second pipe segment 3, there is an intermediate sleeve 12. The suction channel 10, which runs underneath the racks 7 is not shown here. Within the first pipe segment 2 and the second pipe segment 3, the first rack 7*a* and the second rack 7*b* run; they are arranged offset by 180° relative to one another and in the transition region between the first pipe segment 2 and second pipe segment 3, they engage one another with a plurality of teeth and are thus connected to one another.

Figure 5:
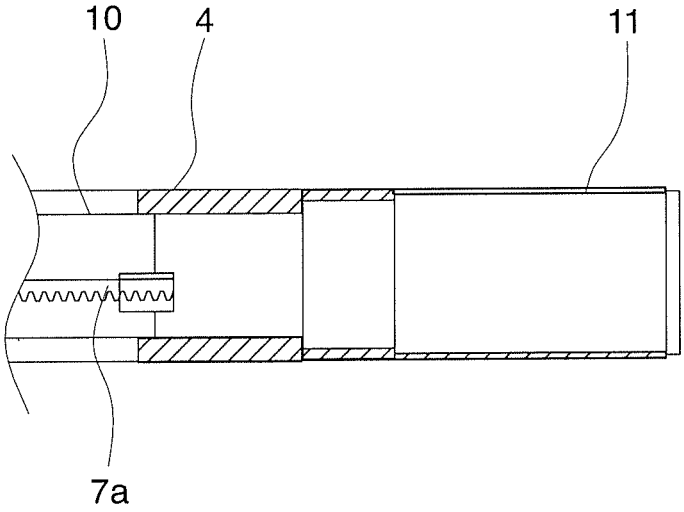
FIG. 5 is a sectional view of a second end section of the exemplary embodiment of a vacuum cleaner suction pipe.

FIG. 5 shows an exemplary embodiment of an end region of the third pipe segment 4 facing away from the first pipe segment 2 in a partial section. A connector 11 which is used as an interface for the suction channel 10 of the vacuum cleaner suction pipe 1 is inserted into the pipe segment 4. The suction channel 10 is inserted positively into the connector 11 so that the connector 11 keeps the suction channel 10 within the third pipe segment 4. Furthermore, the first rack 7*a* is also fixed on the socket 11 so that force is transferred from the rack 7*a* to the socket 11, and thus, to the third pipe segment 4. This socket 11 has an actuating element 13 which is used for detachable latching of the socket 11 to a suction hose which is inserted into the latter and which is not shown.

What is claimed is:

1. A vacuum cleaner suction pipe, comprising:

a first pipe segment, a second pipe segment, and a third pipe segment, wherein the pipe segments are telescopically connected to one another with the first pipe segment being located between the second pipe segment and the third pipe segment, wherein a control device is provided with a mechanical coupling that is adapted to mechanically interact with the pipe segments in a manner causing manual movement of one of the second and third pipe segments in an axial direction relative to the first pipe segment to produce movement of the other of the second and third pipe segments at the same time, wherein the control device comprises at least one control rod, wherein said at least one control rod comprises at least two control rods of which a first control rod is connected to an end of the second pipe segment which faces away from the first pipe segment and a second control rod is connected to an end of the third pipe segment which faces away from the first pipe segment, and wherein the first control rod and the second control rod are in interaction with one another via an actuating mechanism attached to the first pipe segment, wherein the control rods run within the pipe segments.

2. Vacuum cleaner suction pipe in accordance with claim 1, wherein the actuating mechanism blocks a relative movement of the pipe segments relative to one another when the actuating mechanism is not actuated and wherein the actuating mechanism is manually actuatable by a user to enable a relative movement of the second pipe segment and the third pipe segment relative to the first pipe segment.

3. Vacuum cleaner suction pipe in accordance with claim 2, wherein the actuating mechanism is a pressure mechanism.

4. Vacuum cleaner suction pipe in accordance with claim 1, wherein the second pipe segment and the third pipe segment are slidable on opposite ends of the first pipe segment.

5. Vacuum cleaner suction pipe in accordance with claim 1, wherein the mechanical coupling of the control device is connected to the second pipe segment and the third pipe segment in a manner causing the second pipe segment and the third pipe segment to move in opposite directions.

6. Vacuum cleaner suction pipe in accordance with claim 1, wherein the at least two control rods are toothed racks, and wherein the racks are in interaction with one another via at least one gear located on the actuating mechanism so that the gear transfers motion of one of the racks to the other when one of the two pipe segments is moved manually.

7. Vacuum cleaner suction pipe in accordance with claim 6, wherein said at least one gear comprises a plurality of gears adapted to provide a different transmission ratio between the racks of the second pipe segment and of the third pipe segment.

8. Vacuum cleaner suction pipe in accordance with claim 1, wherein the control device comprises four control rods of which two control rods interact with the second pipe segment and two control rods interact with the third pipe segment.

9. Vacuum cleaner suction pipe in accordance with claim 1, wherein the pipe segments have a droplet-shaped cross section, wherein a suction channel passes through each pipe segment, and wherein the control device is located in the pipe segments outside of the suction channel.

10. Vacuum cleaner suction pipe in accordance with claim 9, wherein on an end of each of the second pipe segment and the third pipe segment that faces away from the first pipe segment there is a connector which is permanently connected to the control device and which positions the suction channel within the pipe segments.

11. Vacuum cleaner suction pipe in accordance with claim 1, wherein the pipe segments are hollow and form a suction channel which enables suction to be drawn through them.

12. Vacuum cleaner suction pipe in accordance with claim 1, wherein a socket is provided at an end of the suction pipe, the socket having an actuating element for detachable latching of the socket to a suction hose inserted in the socket.

* * * * *